United States Patent [19]

Alder

[11] Patent Number: 4,491,186

[45] Date of Patent: Jan. 1, 1985

[54] AUTOMATIC DRILLING PROCESS AND APPARATUS

[75] Inventor: Robert L. Alder, Garland, Tex.

[73] Assignee: Smith International, Inc., Santa Ana, Calif.

[21] Appl. No.: 442,162

[22] Filed: Nov. 16, 1982

[51] Int. Cl.[3] ..... E21B 44/00

[52] U.S. Cl. ..... 175/26; 175/27; 173/9

[58] Field of Search ..... 175/26, 27, 107, 38; 173/6, 9

[56] References Cited

U.S. PATENT DOCUMENTS

| | | | |
|---|---|---|---|
| 3,031,169 | 4/1962 | Robinson et al. | 254/273 |
| 3,065,416 | 11/1962 | Teter | 175/40 |
| 3,581,830 | 6/1971 | Stoner | 173/9 X |

FOREIGN PATENT DOCUMENTS

| | | | |
|---|---|---|---|
| 229374 | 6/1967 | U.S.S.R. | 175/26 |

*Primary Examiner*—Stephen J. Novosad

*Assistant Examiner*—Thuy M. Bui

*Attorney, Agent, or Firm*—Klein, Szekeres & Fischer

[57] ABSTRACT

This invention relates to a process of automatic drilling with an in-hole motor particularly of the turbine type. The invention relates to apparatus and process by which the draw works responsive to a signal generated by an in-hole tachometer in the form of a train of pulses of period responsive to the rpm of the motor is sensed by a pressure transducer which generates a signal which is responsive to the rpm of the motor telemetrically in the form of the train of pulses. The signal is converted into a pressure applied to the brake of the draw works driven to hold the tension on the drilling lines and thus holds the rpm of the motor substantially consistant. In the best mode disclosed, this is accomplished by producing an electrical signal responsive to the train of pulses and storing said signal between pulses and generating a pneumatic pressure responsive to the stored signal and applying a force to said driver responsive to said last named pressure.

14 Claims, 16 Drawing Figures

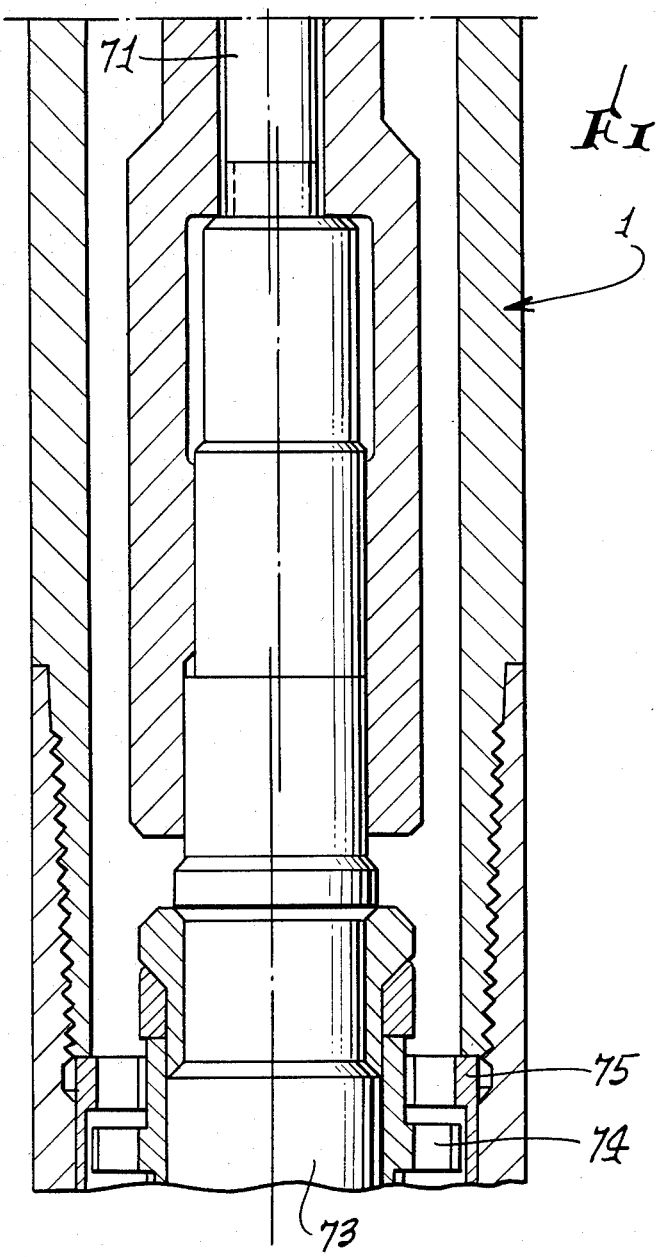
FIG. 2e.
FIG. 7.
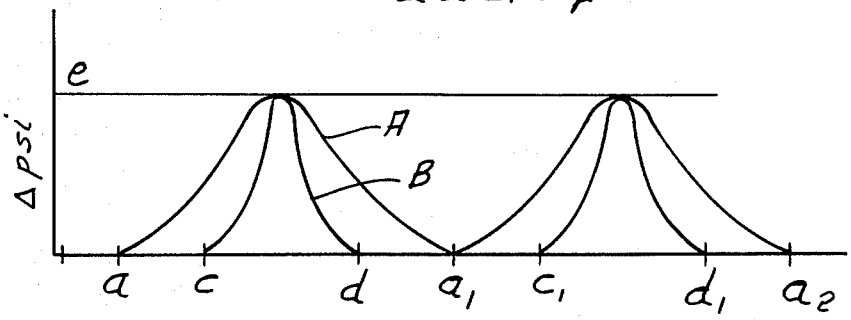

37
28
9
1
38
24
66
41
65
47
48
46
46'
45
64a
49
64
49a
51
62
50
54
24a
52
61
53
58
57

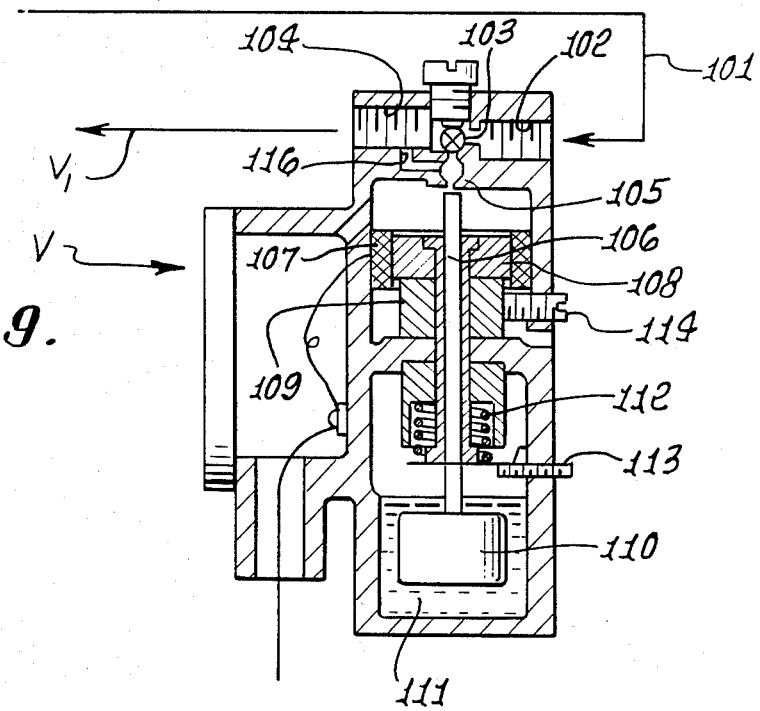
FIG. 9.
FIG. 10.
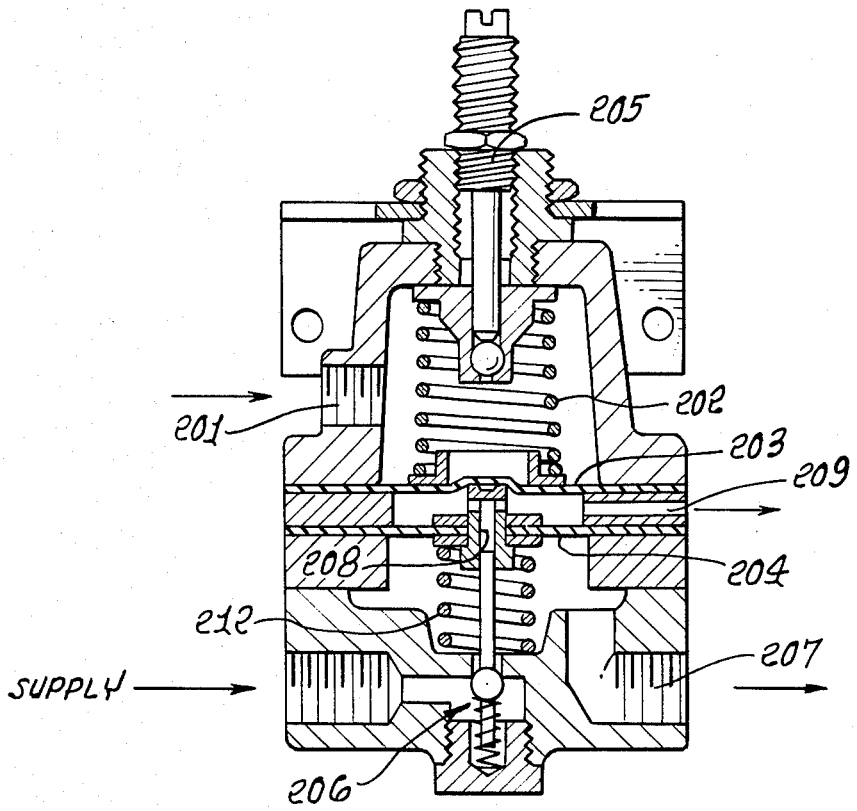

AUTOMATIC DRILLING PROCESS AND APPARATUS

BACKGROUND OF THE INVENTION

The prior art drilling apparatus are of two kinds, differing in where in the drill string the power to rotate the drilling bit is applied. In ordinary rotary drilling, a long string of drill pipe rotates a drill bit by rotation of the drill pipe from the surface.

An alternative method mounts a motor at the end of the drill string adjascent the bit. The motor is operated by the drilling fluid which is pumped down the drill pipe, through the motor and drill bit and circulated to the surface carrying the detritus generated by the bit as it advances to form the bore hole.

One form of such motor is a turbine. This technology is well known and will not need further explanation to those skilled in this art. The performance of the turbine at constant drilling fluid pumping rate (gallons of drilling fuid per minute—gpm) is a function of the rpm (revolutions per minute) of the turbine.

Thus with the bit off bottom, as when the string is lifted from bottom, the turbine runs faster and faster, rpm rapidly increases, with less and less torque until a balance between centrifugal and frictional forces occurs. When the bit is placed in drilling position, the braking effect of the bit rotating on bottom in drilling position at constant drilling input rate (gpm) results in an increase in the torque with a reduction in rpm of the drill.

Furthermore, at a constant gpm, the horsepower output and turbine efficiency passes through an optimum as the rpm increases.

In common practice, both in ordinary rotary drilling as well as in operations with an inhole turbine a portion of the weight of the drill string is imposed on the drill bit so as to obtain as rapid an advance of the drill as is practical for the formations to be drilled.

As in ordinary rotary drilling, so also in the case of turbine drilling, the weight imposed on the drill depends on the tension in the drilling lines from which the drill string is suspended in the derrick.

Excessive increase in tension in the drilling lines not only reduces the load on the bit and thus the drilling rate but if carried too far may cause a rupture of the drill pipe. In the case of turbine drilling, the reduction of load on the bit by increase in the tension in the drilling lines increases the rpm of the turbine, the gpm having been held intact. The increase in rpm, with drilling fluid gpm held substantially constant causes a substantial decrease of torque and thus drill bit advance. The rpm may also move from the desirable range of rpm for optimum efficiency and horse power output.

On the other hand, excessive decrease in tension results in an excessive load on the bit, which in the case of turbine drilling causes a reduction in rpm.

In order to avoid such excess of weight variation, it is common practice to control the braking action of the draw-works (winch) to control the tension in the drilling lines as measured by a tensometers mounted on the drilling lines.

Such controls may be done manually by control of the brake on the draw works, or automatically whereby the brake is automatically set responsive to a signal from the tensometer.

The rpm at which the turbine operates is thus an important criterion of the performance not only of the efficiency of the turbine but also of the proper performance of the drilling rig.

As drilling progresses, and the hole deepens, the brake must allow the drill string to advance at the desired rate while the tension in the lines maintains the desired weight on the bit.

In ordinary rotary drilling this is accomplished either by manual or automatic control of the draw works brake to advance the drill string while maintaining the tension so as to maintain the weight on the drill in the desired range.

The prior art control of the performance of a turbine driven bit by control of the weight of the bit relied on the braking action of the bit which is responsive to the weight imposed on the bit.

The braking action of the bit is affected not only by the weight on the bit, but also by the nature of the formation being drilled.

Reliance on the weight to control turbine performance is thus not entirely sufficient.

STATEMENT OF THE INVENTION

In the system of my invention, the signal to the brake for the control of the tension in the drilling lines comes from the turbine. The rpm of the turbine is reported through the medium of a tachometer, which responds to the rpm of the turbine, as a variation in the pressure at the drilling fluid inlet to the drill string responsive to the rpm of the turbine. This signal is transmitted to the draw works to hold the tension while advancing the bit to control the rpm of the turbine.

The essential difference between the systems of the prior art automatic drills and my invention is that instead of the signal which actuates the draw works coming from a signal generated by a change in tension in the lines, the signal which activates the draw works comes from the pulses in pressure generated by a tachometer positioned adjascent to the turbine and telemetered through the circulating drilling fluid to the input of the drilling fluid to the drill string.

As drilling progresses, the system of my invention reports the rpm of the turbine and drill as pressure pulses occuring in the input of the drilling fluid to the drill string. The pressure pulses are sensed and converted to an electrical signal which is composed of frequencies responsive not only to the rpm of the turbine but also other noises generated both by the pump and the bit. The period of the pulses (the reciprical of the frequency) developed by the tachometer is so largely different from that of the noise background that the train of pulses telemetered by the tachometer may be filtered to remove the background noises. The resultant filtered train of pulses is of a pattern, both as period of the pulses and as the period of time between pulses, is thus of a pattern which is responsive to the rpm of the turbine. The train of pulses is transformed to a voltage or amperage whose value is a measure of the rpm of the turbine. The voltage or current is transformed into a hydraulic or pneumatic pressure which is applied to the brake of the draw works to modify the tension in the drilling lines.

In my invention the recognition of the rpm of a turbine, by a tachometer generates a pressure pulse in the drilling fluid which is transmitted to the surface through the drilling fluid in the drill string. The pulse is sensed at the surface in the drilling fluid input to the drill string. Examples of such telemetry are U.S. Pat. No. 3,065,416 and my copending application, Ser. No. 392,292, filed June 25, 1982.

While I may use any process or apparatus which is available for the generation of recognizable pressure pulses, responsive to the rpm of the turbine, I prefer to rely on the down-hole restriction of the stream of drilling fluid to cause a back pressure which is sensed in the drilling fluid at the input to the drill string in a recognizable pattern.

In one mode of my invention, the rotation of the turbine is transformed into a variation of the restriction of a valve nozzle by cam action. The shape of the cam and the nozzle determines the variation in back pressure across the nozzle, which results in a variation in input pressure at the surface, which is evidenced as a pulse in the pressure sensed at the input to the drill string.

The shape and period of the pulse at the surface follows the shape and the rate of rotation of the cam coacting with a member whose advance into the nozzle varies the shape of the nozzle and therefore keeps the back pressure at a constant drilling fluid flow rate in a recognizable pattern.

The cam shape controls the rate at which the nozzle volume is changed as the cam rotates. Where the cam is of sinusoidal shape and the volume variation also follows a sinusoidal pattern, the pulse period may be equal to the time of rotation of the cam.

Either the cam or the nozzle shape or both, may result in a period of time during the cam rotation, where substantially no change in pressure drop across the nozzle is sensed at the input. This may be followed by a sensible restriction in the fluid flow through the nozzle during a remaining portion of the cam rotation. The pulse period may be of time less than the time of one rotation of the cam followed by a period of time during a remaining portion of the cam rotation when no material restriction in the nozzle occurs.

While either expedient may be used to generate the recognizable pattern of pulses at the surface, the best mode of my invention, as I now concieve it to be, employs the latter of the means to generate the pulse pattern.

In my preferred embodiment, in order to distinguish the pulse period from the background noises, means are provided to hold the rate of rotation of the cam to a low fraction of the rate of rotation of the turbine.

The resultant pulse period is held to a substantially lower period than those of the background noises resulting from the pumping action and other drilling noises. These background noises may be filtered out to isolate the pulses resulting from the tachometer action which is responsive to the turbine rpm.

The pulses of pressure generated by the tachometer appearing as variations in drilling fluid pressure at the drilling fluid inlet to the drill string is sensed by a pressure gauge, such as a conventional pressure gauge, which reports the pressure as either as a voltage or amperage signal. This signal is translated to a fluid pressure either pneumatic or hydraulic pressure responsive to the electrical signal.

The fluid pressure controls the application of the brake to the draw works so that the drill string tension is controled to maintain the rpm of the turbine within the desired range.

In order to control the brake so as to maintain the rpm of the turbine within the desired range, provision is made to sense the pressure pulses reported by the pressure gauge. The gauge transformes the pressure and pressure variations into a signal which reports the pressure variations as a function of time. Such gauges are conventional.

In order to determine the period of the pressure pulse, the shape and rotation of the cam is such that the resultant pulse is of substantially longer period than those of the background noises and the resultant electrical signal which reports substantially all of the frequencies may be filtered to isolate the rpm frequency from the background noises by filtering the electrical signal. Such expedients are common and are well-known.

Provision is made in the best mode of my invention, as I now conceive it to be, to sense the duration in time of the period of the pressure pulse and the period of time between pulses responsive to the rpm of the turbine. The signal is converted into a fluid pressure whose magnitude is responsive to the signal. The advance and tension in the drilling lines is controlled responsive to the signal. Since the signal cannot be developed until the completion of the time between pulses, there is a period of time during each rotation of the cam of the tachometer when no signal is transmitted to the draw works from which the drilling lines feed. Provision is made to hold the drilling lines at the tension within the desirable range during the period of time between the adjustment resulting from the application of the signal from a previous pulse until the arrival of the signal from a following pulse.

DETAILED DESCRIPTION OF THE DRAWINGS

This invention will be further described with reference to the following figures which I now contemplate to be the best mode of my invention.

Figure 2:
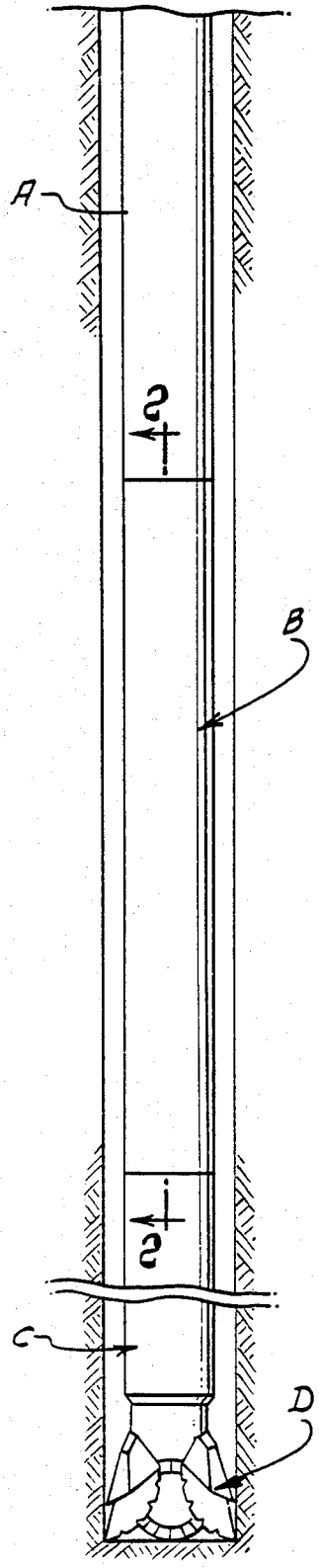
FIG. 2 is a schematic drawing of the lower portion of the drill string shown in FIG. 1.

FIG. *2a* is the upper portion of the cross-section of FIG. 2 taken on line 2—2 of FIG. 2.

FIG. *2b* is the upper section of FIG. *2a*, with the valve in open position.

FIG. *2c* is a lower section of FIG. 2 taken on line 2—2 of FIG. 2.

FIG. *2d* is a lower section of FIG. 2 taken on line 2—2 of FIG. 2.

FIG. *2e* is the extension of FIG. *2d* showing schematic diagram of a portion of a turbine.

Figure 3A:
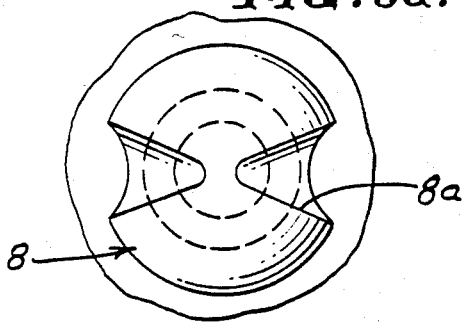
Figure 3:
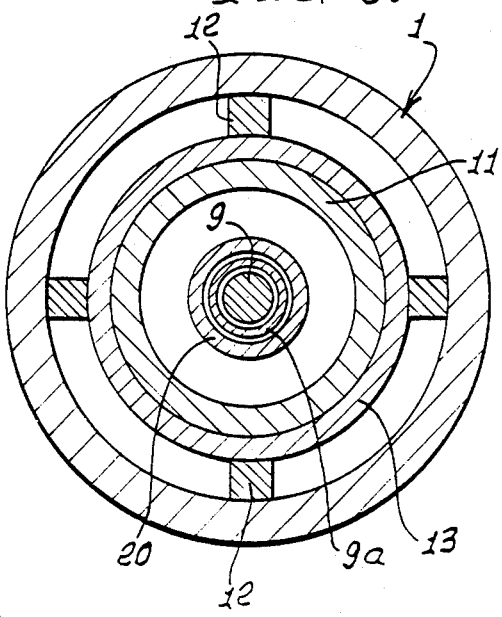

FIG. 3 is a section taken on line 3—3 of FIG. *2b*.

FIG. *3a* is a section of FIG. *2b* taken on line *3a—3a* of FIG. *2b*.

Figure 4:
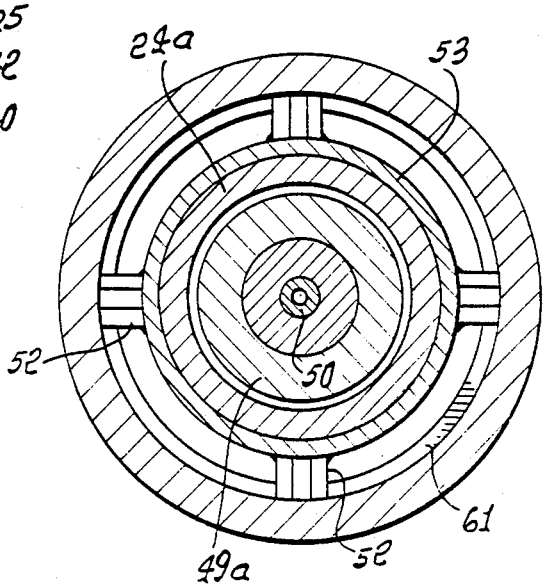

FIG. 4 is a section of FIG. *2c* taken on line 4—4 of FIG. *2c*.

Figure 5:
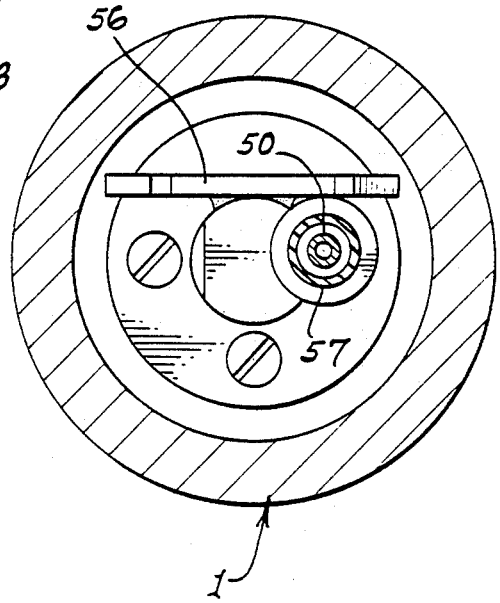

FIG. 5 is a section on line 5—5 of FIG. *2c*.

Figure 6:
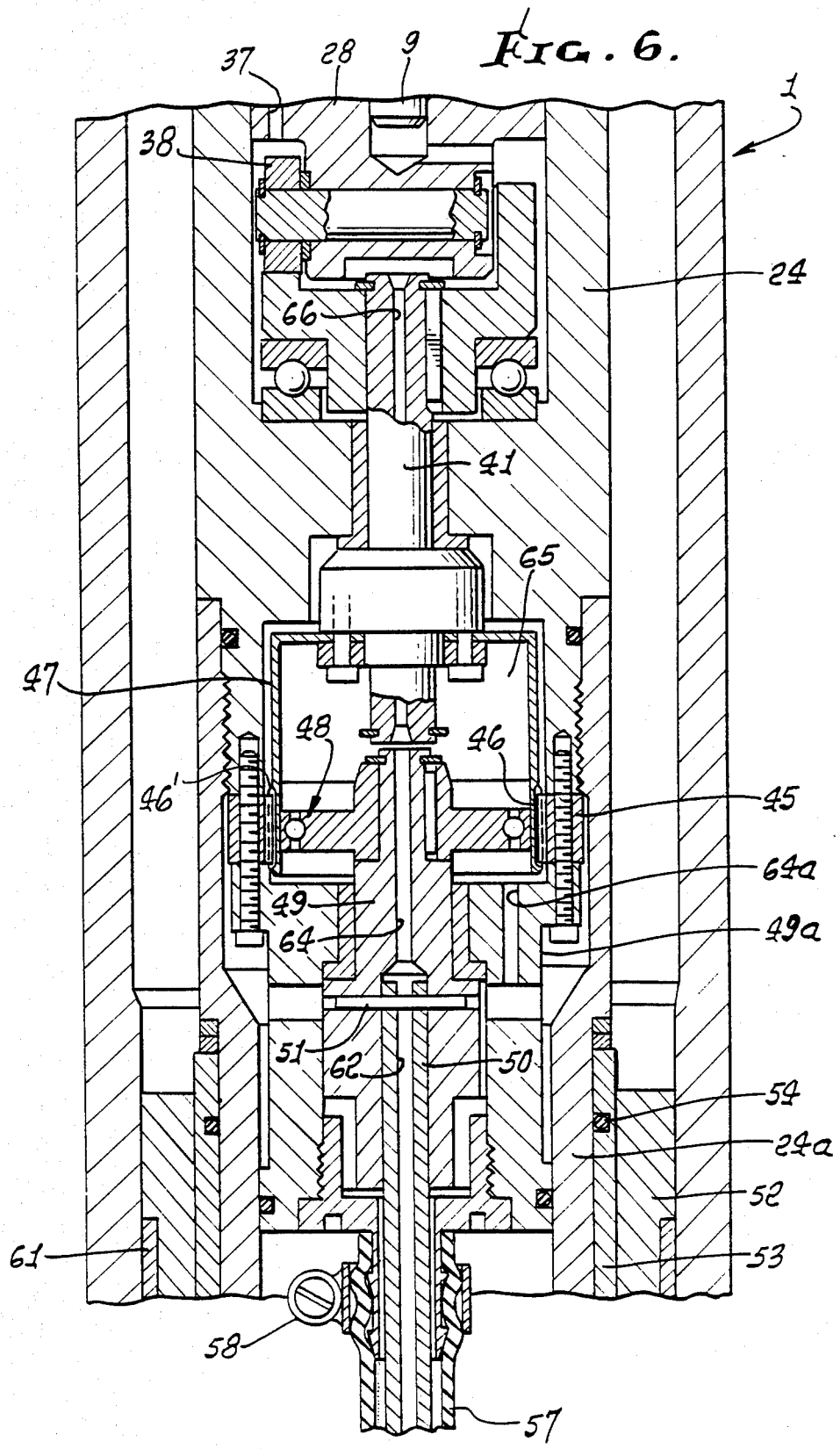

FIG. 6 is a section similar to FIG. *2c* but showing the parts in section which are shown in elevation in FIG. *2c*.

FIG. 7 is a diagram of two forms of a pressure pulse.

Figure 8:
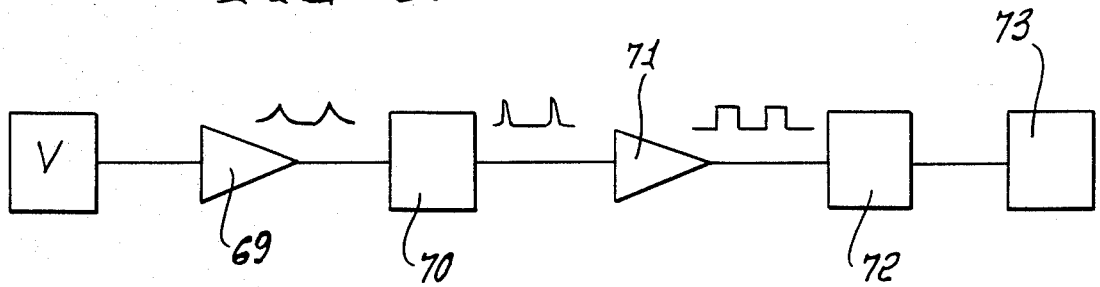

FIG. 8 is a block diagram of an electrical circuit to transform the pressure pulse signal into a signal responsive to the rpm of the turbine.

FIG. 9 is a schematic showing of means to transform the electrical signal into a pneumatic signal for application to the brake control system.

FIG. 10 is one form of pressure amplifier.

Figure 1:
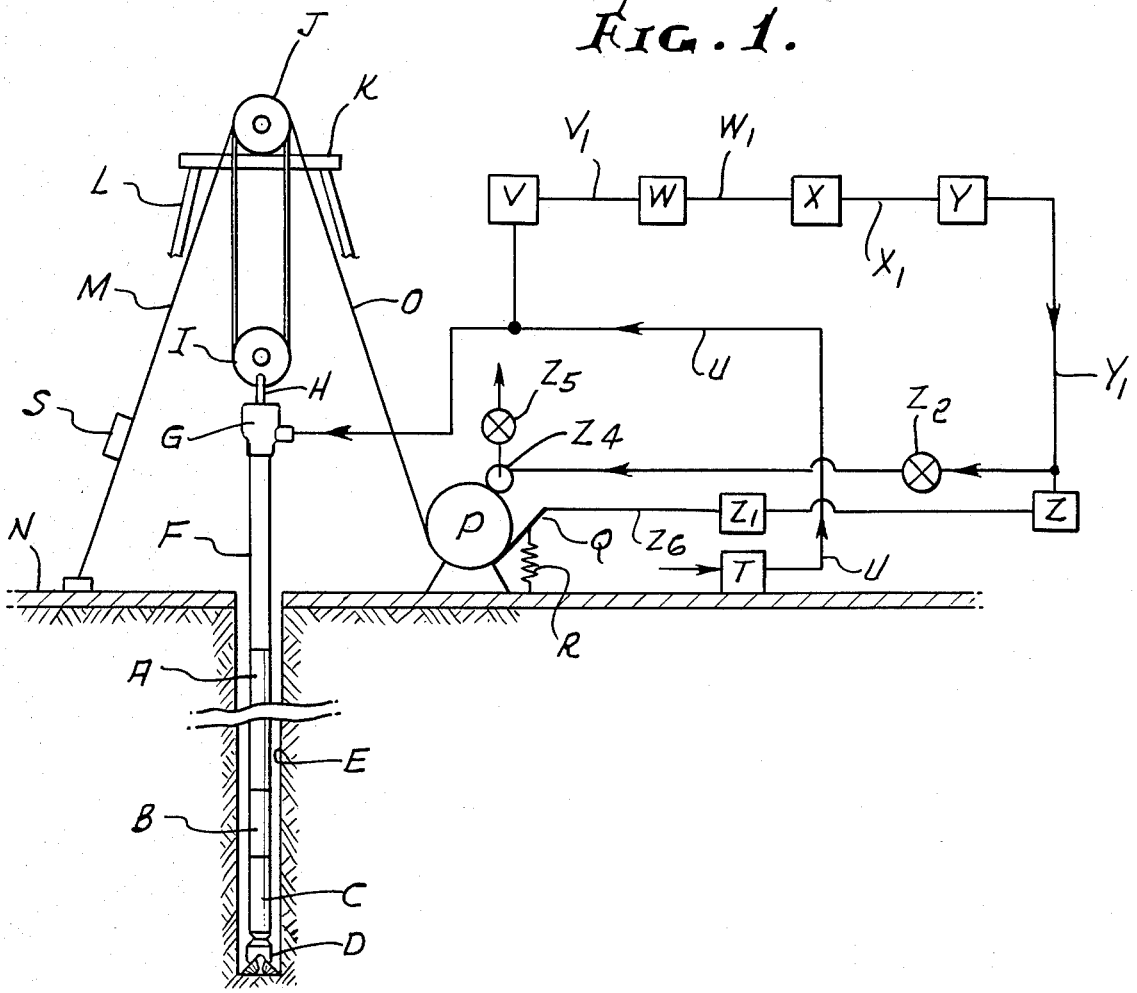
FIG. 1 is a schematic sketch in diagramatic form of an assembly of my invention.

As shown in FIG. 1, and FIG. 2, the drill string A is composed of drill pipe and drill collars, a tachometer B, a turbine C, and as connected to a bit D in a bore hole E. As shown in FIG. 1, the drill string is suspended from a swivel G by a kelly F. The swivel is hung on the travelling block I from a hook H. The travelling block is suspended from the crown block J on the water table K of the derrick L. The drilling lines extending over the crown block and travelling block terminate in the dead line M anchored to the derrick floor N and the fast line O threaded over the draw works drum P. The drum is controlled by brake Q and spring R to maintain a tension in the drilling lines measured by the tensometer S.

The pump T pumps drilling fluid under pressure through line U into the swivel G and through the kelly, drill string, tachometer, turbine, the nozzles in the drill bit and up the annulus E to the surface.

The pressure gauge V senses the pressure in line U and transmits it as an electrical signal via line $V_1$ to the circuit W where it is filtered and transformed into a signal responsive to the pattern of the train of filtered pulses delivered via $V_1$. The signal is transmitted through $W_1$ to a transducer X where it is converted into a pneumatic pressure responsive to the signal received through $W_1$.

The pneumatic pressure is conveyed through pipe line $X_1$ to pressure amplifier transducers Y and Z, and through pipes $Y_1$ at a controlled pressure responsive to the signal received by X. This pressure is transmitted to fluid motor $Z_1$ which applies a mechanical force to brake arm Q through the mechanical linkage $Z_6$ against the action of the spring R.

The rotation of the drum P of the draw works to vary the tension in the drilling lines K operating through roller $Z_4$ opens valve $Z_5$ to vent the pressure in pipe $Y_1$ to atmosphere through manual valve $Z_2$.

The process and apparatus schematically described above will be more fully described below.

The system illustrated by FIG. 1 is an adaptation of a well known automatic drilling apparatus described in U.S. Pat. No. 3,031,169, which is herein incorporated by this reference.

In that patent, the automatic drilling apparatus is applied to an ordinary rotary drilling apparatus. That is a turbine and tachometer is not used or contemplated. The pressure signal is applied to the pressure amplifier Z and the fluid motor $Z_1$ directly from the tensometer S which in the patent controls a fluid pressure applied to a unit such as Z.

The tachometer used in my invention may be one described in the prior art, for example, in U.S. Pat. No. 3,065,416. I prefer to employ the tachometer described in my copending application, Ser. No. 392,292, referred to above.

The tachometer which I prefer to employ in the best mode of my invention, as I now contemplate it to be, is shown in FIGS. 2, 2*a*, 2*b*, 2*c*, 2*d*, 2*e*, 3, 3*a* and 4–6.

The tachometer housing 1, also named sub 1, is connected to the drill string A and to the turbine C, so that the drilling fluid passing down the drill string flows through the tachometer, enters and flows through the turbine C as shown by the arrows (see FIGS. 2*a*, 2*b*, 2*c*, 2*d*).

The tachometer includes the throttle valve nozzle and tachometer assembly positioned in housing 1. The tachometer valve (see FIGS. 2*a* and 2*b*) is composed of orifice ring 4, sealed by O rings 5, mounted with valve orifice 6 of the valve nozzle. The orifice retainer 7 sits on upper stabilizer 12 (see FIGS. 2*a* and 3) through transfer tube 10. The valve member 8, grooved at 8*a*, is mounted on output shaft 9.

The shaft 9 is centered by slotted tube 9*a*. The knob 8 acts as the valve member to vary the valve nozzle opening as it moves through the nozzle approach area 6*a* towards the valve orifice 6. Complete closure of the orifice is prevented by the grooves 8*a*, thus preventing water hammers and turbine stall.

The stabilizer 12 is composed of four fins spaced at 90° intervals secured to the transfer tube 13 held on flange shoulder 14 by ring 15. The shaft 9 is guided in housing 11 by O ring 3, bearing 16 and slotted tube 9*a*.

Figure 2A:
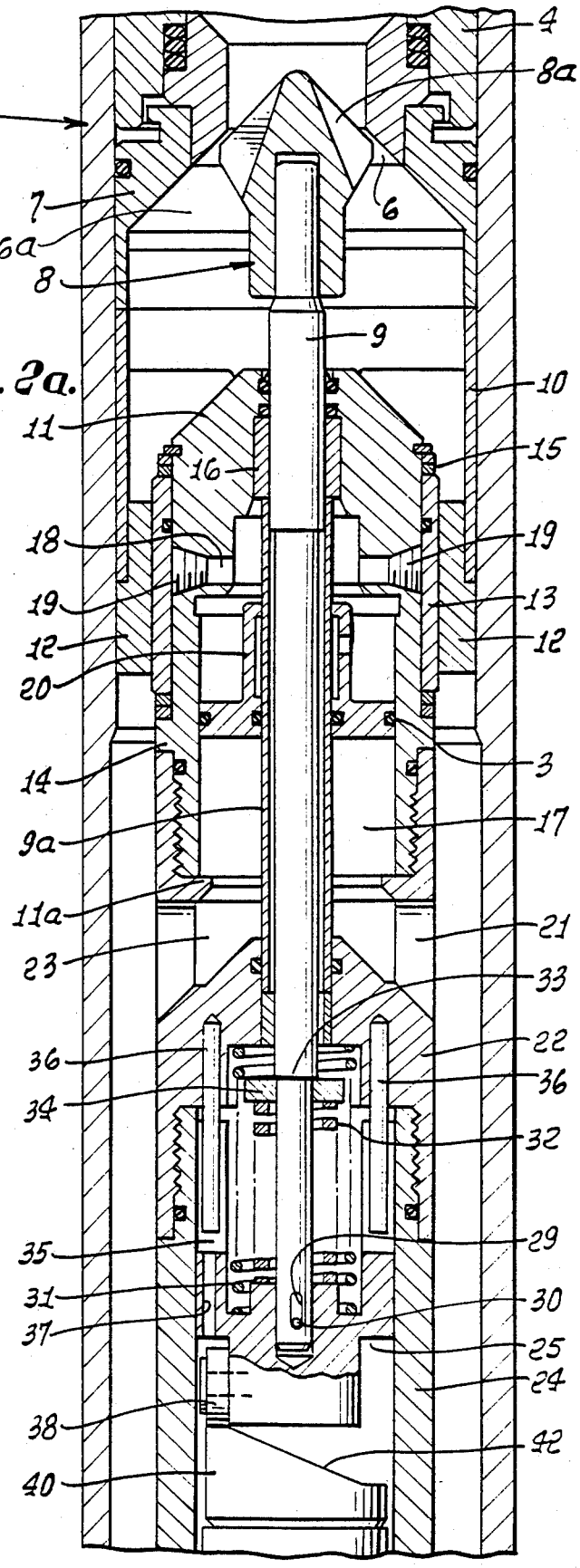
Figure 2B:
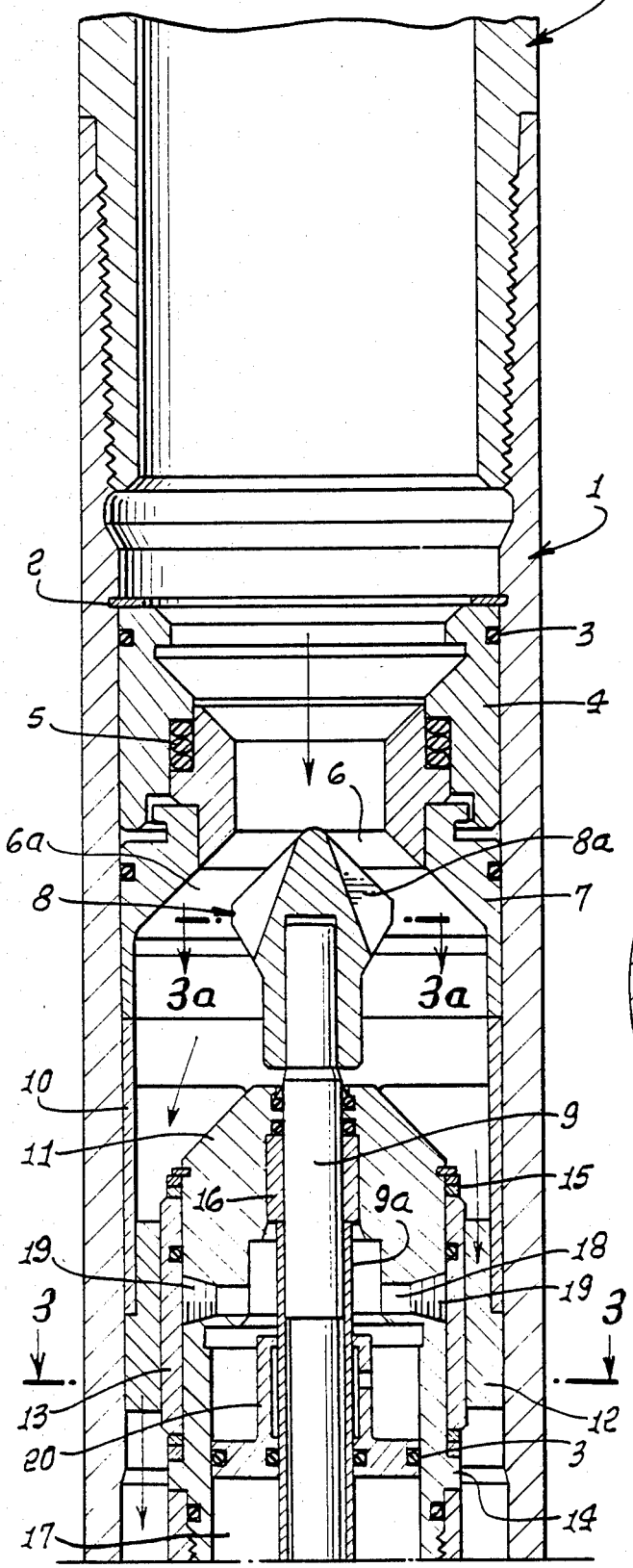
Figure 2C:
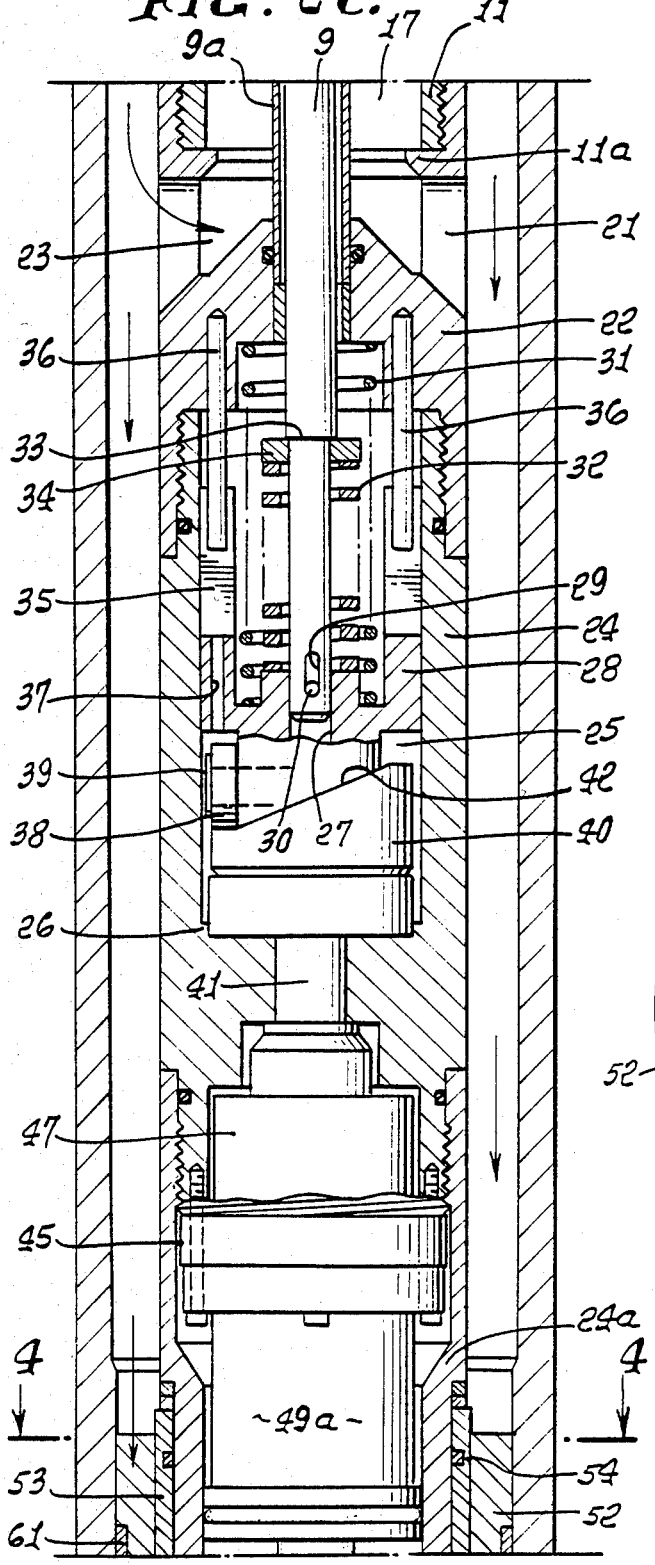

The housing 11 is formed with an open ended cylindrical chamber 17 containing ports 18 sealed by plugs 19 (see FIGS. 2*b* and 2*c*). The equalizer piston 20 is slideably positioned in cylinder 17. It is guided by bearing tube 9*a* and suitably sealed by O rings 3 mounted between the interior and exterior surfaces of the piston and the surfaces contiguous thereto.

The housing 11 is connected to the tubular extension 21 (see FIG. 2*c*) extending from cam housing cap 22. The tubular extension 21 is notched to provide passageway 23 from the exterior of housing 11 and cam housing cap 22 to underneath the equalizer piston 20.

The cam housing 24 is bored to form a chamber 25 having floor 26 which is counterbored for purposes described below.

The shaft 9 extends through the cap 22 into chamber 25 (see FIGS. 2*a* and 2*c*) and into the bore 27 of the cam follower body 28. The shaft is slotted at 29 and pin 30 passes through the slot 29 and into the cam follower body 28.

The spring 31 is positioned within the chamber 25 between the cam follower body 28 and the cap 22 and concentric with shaft 9. The spring 32 extends between the cam follower body and shoulder 33 on shaft 9 and biases the shaft through the washer 34.

The cam follower body 28 is notched at 35. The pins 36 pressed into the housing cap 22 extend into the notches. The cam follower body is bored at 37 connecting the space in chamber 25 below the cam follower body 28 with the space above the cam follower body.

The cam follower 38 is journaled on journal 39, and rides on the surface of cam 40 (see FIGS. 6 and 2*a*). The tubular cam is mounted on the cam shaft 41.

The vertical displacement of the cam follower 38 and the cam follower body 28 as a function of the angular rotation of the cam surface 42 of the cam 40 follows a relation designed to produce the pressure pulses of the desired shape. The cam lifts the cam follower the required height to displace the shaft 9 sufficiently to move the valve knob 8 through the valve approach 6*a* towards the valve orifice 6, of the valve nozzle from the full open position to the extreme elevated position (see FIGS. 2*a* and 2*b*).

The cam follower is held against rotation by the pins 36 which, as has been described above, are pressed into cap 22 and entered into notches 35.

The cam 40 is rotated by crank arm 43 (see FIG. 2*d*) through the speed (rpm) reducer (see FIGS. 2*c* and 6).

The time rate of reciprocation of the knob 8 caused by the rotation of the cam is held reasonably low in order to prevent confusion so that the time rate of the pressure pulses at the surface is held low and thus may be distinguished from the acoustic noises induced by the drilling operations.

Furthermore, the translation of the rotary motion of the input shaft 50 to the linear displacement of the output shaft 9 may occur whether the direction of rotation of the input shaft is clockwise when the turbine is in drilling mode, or counterclockwise direction when circulation through by-pass valves, such as is shown in U.S. Pat. Nos. 3,989,114 or 4,298,077, when the drill string is lowered or removed from the well as in "tripping".

In order to obtain pulses of the period preferred in my invention, as described herein, I prefer to employ a speed reducer of high gear ratio. While other forms of speed reducers, for example, a worm gear drive, may be used, for the best mode of my invention, as I presently contemplate it to be, I prefer to use the Harmonic Drive sold by USM and illustrated in FIGS. 2*c* and 6.

The drive is composed of the fixed circular spline case 45 bolted to cam housing 24 and carrying internal spline teeth 46. The non-rigid cylindrical thin walled cup 47 carries external spline teeth 46' which mesh with the spline teeth 46 of the circular spline. The splines 46' are two less in number than spline teeth 46 and are on a smaller pitch diameter. The eliptical ball bearing assembly 48 is rotatably mounted on drive shaft 49 and pinned to input shaft 50 by pin 51.

The non-rigid member 47 conforms to the eliptical assembly 48 and causes a limited number of splines on the non-rigid member to mesh with the spline teeth on the circular spline.

Housing extension 24*a* on housing 24 which is positioned in housing 1 by stabilizer 52 arranged at 90° intervals secured to transfer tube 53 similarly to the stabilizers 12 (see FIG. 4). The transfer tube 53 is sealed by O ring 54 and held by retaining ring 55 (see FIGS. 2*d* and 6).

The turbine may be any conventional turbine, for example, such as is presently employed in drilling of bore holes. Since such turbines are standard equipment, except for the paddle described below, wellknown to those skilled in this art, the description is omitted for purposes of brevity.

Figure 2D:
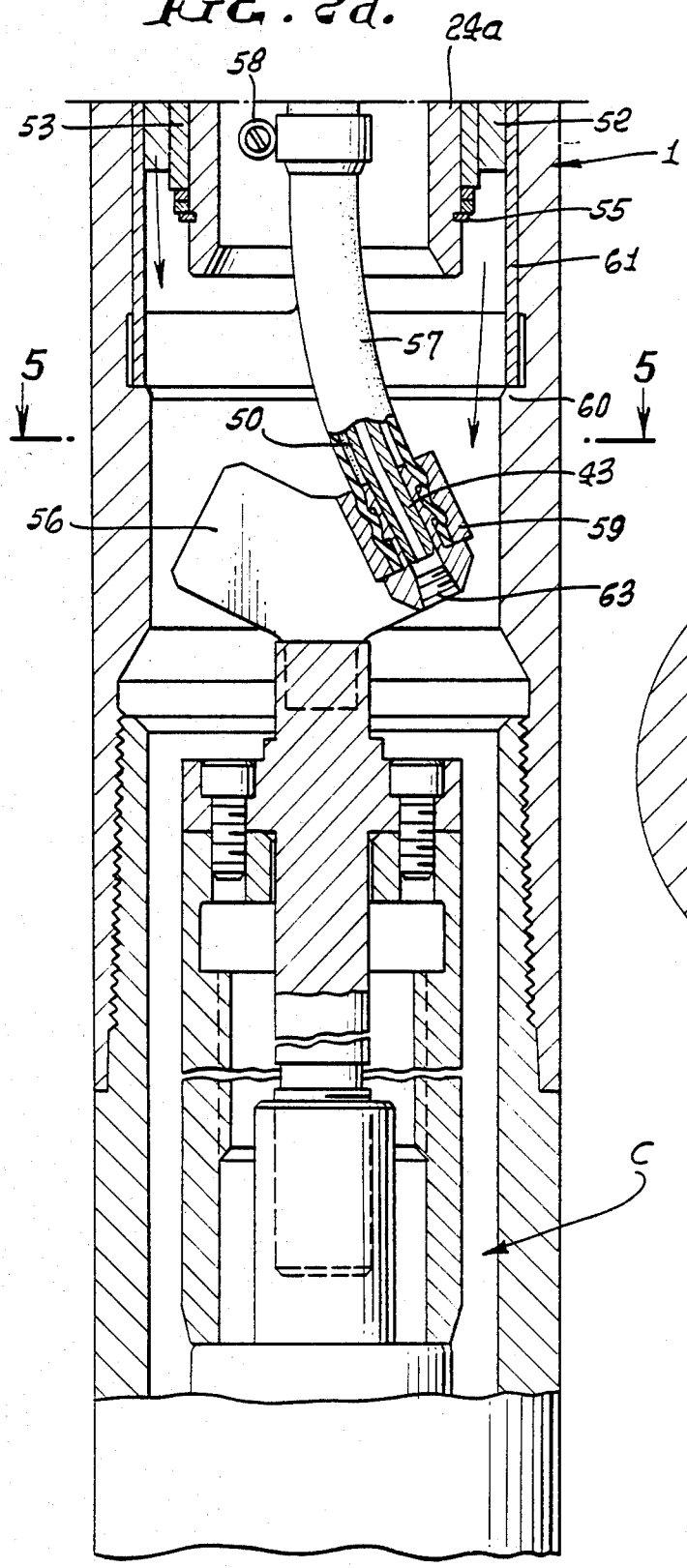

The paddle 56 is mounted on the rotor shaft extension 64 of the turbine and extends into housing 1. The tachometer input shaft 50 at its end is bent into crank arm 43 against which the paddle 56 may push to rotate the input shaft 50 (see FIG. 2*d*). As shown in FIGS. 2*d* and 6, the input shaft and crank extension are encased in a flexible sheath 57 clamped by clamps 58 and 59 (see FIG. 2*d*) of a conventional turbine rotor 65 carrying turbine blades 66 (one only shown, FIG. 2*e*) coexisting with stator blades 67 (one only shown). As is well known, there may be as many as 40 to 50 pairs.

The tachometer load is transferred to the internal shoulder 60 of housing 1 through transfer tube 61. The tachometer is thus secured in housing 1 between the shoulder 60 and ring 2 of FIG. 2*b*.

Prior to the assembly of the tachometer plugs 19 are removed from ports 18 (see FIGS. 2*a* and 2*b*) and the chamber 17 above the equalizer piston 30 is filled with lubricating oil displacing the equalizer piston to seat on the internal should 11*a* at the end of housing 11.

The cam housing 24 (see FIG. 6) may be evacuated through bore 62 in drive shaft 50 by removing the plug 63 at the end of crank 43. The bore 62 communicates with the space 65 above and below the eliptical assembly 48. This is established through the bore 64 in the shaft 49 and the bore 64*a* in input eliptical assembly drive shaft case 49*a*. Communication is also had through bore 66 in shaft 41 with the cam housing containing the cam mechanism.

Communication is also provided from beneath cam follower body 28 to above the body through bore 37. The slotted tube 9*a* provides for fluid passageway. (See FIG. 2*c*)

After evacuation of the spaces through the above fluid passageways, the spaces may be filled with lubricating oil through ports 18 and the passages stated above and the annulus between shaft 9 and slotted tube 9*a* to above the equalizer piston 20.

As will be seen all moving parts of the transducer within the housings 11 and 24 and 24*a* are enclosed in lubricating oil against intrusion of drilling mud. The input shaft is secured against erosion by drilling mud by the flexible casing 57.

Drilling fluid entering the housing 1 (FIGS. 2*b* and 7) flows between the housing and the tachometer assembly as shown by the arrows on the figures. The hydraulic thrust of the flowing drilling fluid exerted on cap 11 transferred through transfer tube 61 (see FIG. 2*c*) is carried on the shoulder 60 (see FIG. 2*d*). The load is balanced by the fluid pressure of the drilling mud which is communicated from the annulus between the tachometer assembly and the housing 1 through the ports 21 to piston 20 (see FIGS. 2*a* and 2*b*).

The free floating equalizer piston 20 compensates for changes in thrust arising from variations in drilling fluid flow rate and temperature changes.

The tachometer assembly is centered in housing 1 by the stabilizers 12 (see FIGS. 2*a* and 2*b*) and stabilizer 51 (see FIGS. 2*c* and 2*d*).

The turbine rotor operates at a high rpm in the range of about 400 to 2000 rpm.

The torque developed by the turbine is inversely proportional to the rpm of the rotor.

The pressure drop across the valve nozzles composed of the valve orifice 6 and valve orifice approach 6*a*, is substantially the entire pressure drop across the tachometer, since the entire flow of drilling fluid by-passes the tachometer actuating mechanism and exits the tachometer into the turbine to which it may be connected. In order to limit the pressure drop across the valve orifice on the extreme of the travel of the valve knob 8 towards the orifice 6, the knob is grooved at 8*a* (see FIGS. 2*a*, 2*b* and 3*a*). The grooves prevent the complete closure of the orifice and also the development of water hammer.

The turbine output shaft, as stated above, rotates at a high rpm. The axial translation of the valve knob 8 is desirably at a much smaller time rate. The rotation of the paddle 56 and crank 43 and input shaft 50 is at the rpm of the turbine output shaft. A speed reducer is imposed between the input shaft 50 and the cam 40 (see FIGS. 2*c* and 6).

The cam follower rises through its vertical movement on 180° rotation of the cam (see FIG. 2*a*) and returns to its lower position on 360° rotation of the cam (see FIG. 2*c*). In so doing, the knob 8 travels from the position shown in FIG. 2*b* to the position shown in FIG. 2*a*.

Due to the frequency of the resultant pressure wave and the frequency of the sonic noise developed in the bore hole during drilling, it is desirable in the preferred embodiment of my invention, to severely limit the frequency of the pressure wave, i.e. its period, developed by the cyclic translation of the valve knob 8 as it cyclically enters and exits from the valve nozzle and cyclically varies the passageway through the valve nozzle through which the drilling fluid circulates.

The period of time during each revolution of the cam during which a sensible change in back pressure is created at the valve nozzle depends on the shape of the valve and on the shape of the cam. The period of the resultant pulse of pressure relates to the aforementioned period of time.

| | |
|---|---|
| If N = | the rpm of the turbine, |
| A = | the revolutions per second of the cam, |
| a = | the gear ratio between N and A; |
| If R = | the fraction of each revolution of the cam during which a pulse is telemetered to the surface which is sensed at the surface. |

The period of the pulse so generated expressed in seconds (P):

$$P = \frac{R}{A} = \frac{N \cdot R}{60 \cdot a}$$

In turbine operated drills, a usual turbine rpm is in the range of about 400 to 2000. In my invention in the best mode as I now contemplate it to be, the value of "a" is in the range of about 100 to about 200. The value of R may be 1 and as a practical matter, R may be less than 1.

The shape of the pulse as well as its period as a function of real time, depends on the shape of the cam and its rpm as well as on the change in the fluid approach path through the valve as the area of the path changes as the cam rotates.

In the best mode of my invention, as I now contemplate it to be, as shown in FIGS. *2a, 2b* and *3a,* the valve nozzle is composed of a valve orifice 6 and an orifice approach *6a.* The valve knob is in shape to complement the shape of the orifice approach *6a.* As described, the valve knob is grooved.

As the valve knob approaches from its full open position, as shown in FIG. *2b,* to the closed position, as shown on FIG. *2a,* during one half of the complete 360° rotation of the cam and during the first portion of the movement of the valve knob 8 as it moves through the approach region *6a* of the valve nozzle, the change in the free cross sectional areas of the fluid path through the valve nozzle makes substantially no change in the pressure drop in the fluid path. However, as the valve knob 8 approaches the valve orifice 6, the reduction in the free area is significant and results in a significant increase in the back pressure.

The reverse is true during the second half of the cam rotation. The sinusoidal translation of the valve knob 8 by the sinusoidal cam combined with the shape of the valve nozzle *6a* and valve knob 8 may thus result in a pressure pulse of the form shown as A or B in FIG. 7. Different shapes of the valve nozzle and or cam shape or both will result in different pulse shapes and periods.

In the best mode of my invention, illustrated by the FIGS. *2a–6,* the cam shape and the valve nozzle, as illustrated, results in a pulse as illustrated by trace B of FIG. 7.

The pulses developed by the cyclic translation of the knob 8 is at a frequency which permits of adequate filtering to isolate the higher frequency noises of drilling and transmit the signal of the resultant low frequency pulses generated by the tachometer.

The output shaft, as has been described, is mounted in the cam follower body which is held against rotation by pins 30 in slot 29. The spring 32 biases the output shaft and knob 8 towards the orifice 6. The spring constant of spring 32 is sufficiently large to extend the shaft 9 against the hydraulic pressure imposed on the knob 8, so as to hold the pin 30 in the slot 29 as shown in FIGS. *2a, 2b* and 6.

As the cam follower cycles it imposes a cyclic force on the spring 32 which thus holds the shaft 9. The shaft 9 is thus resiliently connected to move with the cam follower without substantial deflection of the spring 32.

Should the pressure of the drilling fluid exerted on the valve knob 8 increase substantially, the additional back pressure at the valve knob 8 will compress the spring 32 and deflect the shaft 9 in slot 29 into the bore 27 (see FIG. *2c*), thus increasing the orifice opening and reducing the pressure.

The spring 32 thus acts as overload protection to limit the magnitude of the pressure drop across the orifice 6, and substantially increases the flow rate of the drilling fluid.

The tachometer described above is positioned in the drill-string as described above and in operation will develop pressure pulses which are sensed by an electromechanical pressure gauge and translated into an electrical signal. Such pressure gauges are well known and widely used to measure pressures. One such is used in the system illustrated by the schematic FIG. 1 (see V).

The pressure gauge will respond to the pressure variations imposed by background drilling noises as well as the pressure pulses resulting from the variation of the valve nozzle by the reciprocation of the knob 8.

Referring to FIG. 8, the output of the pressure gauge V is amplified in amplifier 69 and filtered in filtering circuit 70. The filtered output will have the period and shape depending on the cam gear ratio and valve nozzle as described above.

The filtered output is the electrical analogue of the pressure pulses delivered by the tachometer. It is delivered to a comparator 71 where it is transformed into a square wave of period equal to the real time between the arrival of one pulse and that of the following pulse as determined by the tachometer. (See FIG. 7.) Such comparators are well known and are offered as silicon chip integrated circuits.

The output of the comparator is fed to a computer 72 which includes a crystal controlled square wave oscillator and a counter. The arrival of the square wave from the comparator initiates the counting of the square wave output of the oscillator which continues during the period between the arrival of one signal from the comparator to the time of arrival of the succeeding pulse.

The counter counts the number of the square wave pulses delivered to the counter from the oscillator during the period of time between the arrival of the pulses and delivers a digital signal responsive to that period.

Such computers are well known and are commercially available in the form of silicon chips.

The output from the computer is delivered to a converter 73 which stores it in a register. The signal from the computer is made available as an analogue signal by the converter until it is altered by a succeeding signal from the computer.

Such devices are commercially available and are well known to those skilled in this art.

The output from the converter is amplified and connected to the electric-to-pneumatic transducer W via $V_1$. One form of such transducer is available on the market by Moore Products Co. of Spring House, Pa. 19477. It is illustrated in FIG. 9.

Pneumatic pressure from a source 101 enters port 102 passes through restriction 103 to the output port 104.

The pressure drop across restriction 103 is modified by the by-pass through nozzle 105 controlled by the top of the shaft 106 which serves as a nozzle seat. The vertical displacement of the shaft and therefor the nozzle orifice controls the discharge of fluid through the nozzle to the external exhaust port 104. The shaft is mounted on a float 110 in chamber 111 containing fluid such as silicone oil.

The device will deliver a fluid at a pressure responsive to an electrical signal applied to coil 107 cooperating with the pole piece 108 and the permanent magnet 109. The zero adjustment of the nozzle with no signal to the coil is made by adjusting the spring 112 through the zero adjustment 113.

The adjustment of the range of pressures through which the transducer operates is made by varying the gap between the permanent magnet and the end of the screw 114 which shunts a portion of the magnetic field and thus changes the flux density through the coil.

The shaft assembly is mounted on the float 110 in the oil filled chamber 111. The float is sized to the oil and assembly mounted on the shaft 106 and is designed to create a state of neutral buoyancy which acting with the viscous damping produce a system stable to vibration and shock.

The current passing through the coil 107 reacts with the magnet 109 to force the shaft 106 close to the nozzle to restrict the flow of fluid exhausting from the nozzle through port 106. The back pressure at the nozzle (i.e. the transducer outlet pressure at 104) acts on the area of the nozzle seat at the top of the shaft 105 to unbalance the force produced by the coil. The transducer output pressure is at all times directly proportional to the coil current.

The pressure output of the transducer W (FIGS. 1 and 9) which is directly proportional to the electrical signal developed by the gauge V and the circuit W (see FIGS. 1 and 9) is amplified in the pressure amplifier Y (see FIGS. 1 and 10).

As shown on FIG. 10, the pressure at the input 201 to the amplifier from the electro-pneumatic transducer is balanced by biasing springs 202 acting on the spaced diaphragms 203 and 204, adjusted by the biasing adjustment screw 205.

A high pressure supply from source 201 feeds through pilot valve 206 to the output port 207, and through orifice 208 into between the spaced diaphragms 203 and 204 to the exhaust port 209.

Such transducers are currently sold by Moore Products Co., supra.

In the above transducer, the pressure applied at 201' which is proportional to the pressure sensed at V (FIGS. 1 and 9), acts on the upper diaphragm 203. The force thus applied is opposed by the output pressure at 207 and the spring force from springs 202 and 212. The spring bias is adjusted by screw 205. Should there be an unbalance between theses opposing forces, the pilot valve 206 which throttles the supply is adjusted until the balance is reestablished.

The high pressure output may be further amplified and applied to the brake operating system of any prior art system which operates the draw works. Such draw works are conventionally used on drilling floors of derricks. They are in the prior art operated by a signal from tensometers mounted on drilling lines.

One embodiment known to me and which in my present state of knowledge of the design of such automatic drills is described in U.S. Pat. No. 3,031,169. I have therefor selected to employ the fluid motor and mechanical brake adjustment and feed back described in said patent in the best mode of my invention as I now contemplate it to be.

The output from the pressure amplifier Y may be applied to amplifier V (FIG. 1). (Such amplifier is marked C on FIGS. 1 and 3 of U.S. Pat. No. 3,031,169.) Instead it may be directly connected to the pneumatic motor Z-1 (FIG. 1). (Such a motor is shown as D on U.S. Pat. No. 3,031,169.)

The motor is connected by a mechanical linkage to the brake of the draw works drum O (see FIG. 1 and see also U.S. Pat. No. 3,031,169). The pressure applied by the motor acts through a linkage against spring R to hold the tension in the drilling lines (see U.S. Pat. No. 3,031,169).

As is described above, a signal in the form of pressure applied to the motor Z-1 will adjust the brake to permit the drum O to rotate. As the drum rotates, the valve $Z_5$ is opened by the rotation of the roller $Z_4$ (see roller 60 of U.S. Pat. No. 3,031,169) which opens a vent to the atmosphere from line $Y_1$ (see FIG. 1 and also FIGS. 1 and 3 of U.S. Pat. No. 3,031,169). Since the structure and operation and utility of the by-pass through the vent valve $Z_5$ is described in said patent, incorporated in this application by reference, repetition of that description is unnecessary.

The following example of the operation of the system is given as an illustration and not as a limitation of the functioning of my invention.

The turbine operates efficiently at rpm in the range of 400 to 2000 rpm. Thus, the gear ratio of the speed reducer, as described above, is designed to recipricate the knob 8 per revolution of the cam 40 over a period of time ranging from about 2 to about 24 seconds. The gear ratio of the rpm reducer is adjusted according to the formula described above.

The resultant pressure pulse received at the surface is responsive to the rpm of the turbine as translated by speed reducer and cam and valve knob operating in the valve approach and orifice.

As illustrated by FIG. 7, trace A is generated by a cam and valve which in one rotation generates a pressure pulse A of time period $a-a_1$, beginning at time a at 0° of the cam rotation and ending at time $a_1$ on 360° of cam rotation.

In the case of the valve nozzle, such as one composed of approach 6*a* and orifice 6, and valve knob 8, the rotation of the cam, results in the trace B. The cam in this case may have, for example, a dwell of 15° at the start (0°±7.5°) of the rotation of the cam and a dwell of 15° at the end of the rise (i.e., 180°±7.5°).

The train of pulses developed may have the shape and period of trace B in which the train is composed of pulses of period $c-d$ followed by pulses of like period $c_1-d_1$ separated by a time $d-c_1$.

The duration of one revolution of the cam is represented by $a-a_1$ which in time is equal to $c_1-c_2$. The time interval between the initiation of one pulse and that of the following pulse is measured by the circuit of FIG. 8 and reports a parameter which is responsive to the rpm of the turbine.

If the cam results in the trace A, the pulse duration is the time of rotation of the cam, i.e. the time representd by $a-a_1$.

The amplitude of the pulse represented by $d-e$ of FIG. 7 measured by the gauge V in pounds per square inch, change in pressure at the input to the drill string, is proportional to the magnitude of the pressue pulse generated by the reciprocation of the knob 8 (see FIGS. 2*a* and 2*b*). For example, the variation in the valve nozzle by knob 8 may result in a pressure pulse at the surface in the range of about 50 to 250 psi at an input pressure and flow rate (gpm) sufficient to produce an rpm of the turbine in the range of about 400 to about 2000 rpm and the pressure drop through the nozzles as is conventionally required for the type of bit employed.

The following example is illustrative of the performance of my invention and not as a limitation thereof. A cam in which the rise constitutes 330° with a dwell at 15° about the region at 0° and a dwell of 15° about the region at 180°, acting in cooperation with a valve nozzle as illustrated in FIGS. 2*a* and 2*b*, may operate to produce a pulse of duration c−d (trace B) of four seconds preceded by a period of $2\frac{1}{2}$ seconds during the period a−c and followed by a period of $2\frac{1}{2}$ seconds during the period d−$a_1$. A range of the amplitude (f−e) of about 60 to about 75 psi may result from an input pressure of 1425 psi, employing a cam as described operating with a reducer of gear ratio of 160 represents a turbine of 1067 rpm, i.e. a cam rotating once every nine seconds.

The gauge at V will report the pressure and pressure variation as a function of time. The circuitry will measure the time between the start of one pulse and the arrival of the following pulse, for example, the time c−d in the case of trace B of FIG. 7, which in the example is four seconds. Since the signal in such case (trace B) is not available until the completion of the period, i.e. at time $a_1$, and no substantial signal is transmitted by $W_1$ during the remaining periods of the train, the signal derived at time $a_1$ is held in a memory and made available to the transducer X (see FIG. 9) until the arrival of a following pulse signal, for example, at $a_1$. In the case of the pulse A (FIG. 7), the signal is derived at time a and held until the following signal at $a_1$.

The signal from the memory responsive to the period of rotation of the cam is applied as described above through line $V_1$ to the input terminal of $W_2$ of FIGS. 1 and 9.

In operating the system, the load on the bit is adjusted by disconnecting the line from V to W of FIG. 1. If the system requires, the brake is also disconnected from the mechanical linkage $Z_6$ and thus from motor $Z_1$. The weight on the bit is adjusted by setting the brake until the tensometer S reports the proper tension in the conventional manner. Holding the weight constant by adjustment of the brake, the drilling fluid input pressure and flow rate (gpm) is adjusted until the desired rpm of the turbine is reported by V. The output from V is then connected to W, and the linkage $Z_6$ to $Z_1$ is connected, if it has been disconnected.

The brake is thus set responsive to the rpm of the turbine reported at V. The signal from V obtained at the completion of the rotation of the tachometer cam is applied to the brake during the period between the start of one pulse and the start of the following pulse.

The signal derived from V is translated into a fluid pressure to the fluid motor $Z_1$ and applied through the mechanical linkage to the drum of the draw-works as a constant braking force to hold the rpm reported at V substantially constant until the pressure of the fluid to the motor $Z_1$ is changed, responsive to a change in the rpm signal from V.

The control of the weight imposed on the bit is thus responsive to the rpm of the turbine and held constant until such weight causes an undesirable change in the rpm whereupon it is automatically adjusted to re-establish the rpm.

The advance of the bit and the rotation of the drum under the control of the brake is adjusted should the signal from V change and like pressure delivered by the pressure amplifiers Y and Z (if used) held constant until the signal from V is changed, if the rpm of the motor changes in a material sense.

As the drum rotates, the valve $Z_5$ is periodically opened by the rotation of the drum to vent the pressure applied to the motor as is described in U.S. Pat. No. 3,031,169. The pressure generated at the input to the motor is reestablished and thus applied during the period of rotation of the tachometer cam responsive to the rate of rotation of the turbine (rpm).

I claim:

1. An automatic in-hole motor driven drill connected in a drill string supported from the surface, said drill string containing a tachometer to sense rpm of the motor and to generate pressure pulses in the pressure of drilling fluid circulating through an input to the drill string, through the tachometer, turbine and the bit to the surface, a support for the drill string limiting the weight of the drill string imposed on the bit, comprising:

(a) means at the input for sensing the pressure and pressure pulses generated by the tachometer and for generating a signal responsive to said pressure pulses, and (b) support adjustment apparatus operatively connected to said means to modify the weight of the drill string on the bit responsive to said signal.

2. In the drill of claim 1, said support adjustment apparatus comprising a derrick supporting drilling lines, which are connected to a draw works and support said drill string, said drilling lines held by the draw works under tension sufficient to support a portion of the weight of the drill string, said draw works being responsive to said signal to adjust the draw works and resulting tension in the drilling lines responsive to said signal.

3. In the drill of claim 2, said draw works including a winch drum which holds the drilling lines under tension by the braking action of a brake, a pneumatic motor connected to said brake, a source of pressure to said motor, said pressure source being responsive to said signal.

4. The in-hole motor driven drill of claim 1, in which the support adjustment apparatus modifies the weight of the drill string on the bit to maintain said rpm of the motor substantially constant, responsive to the signal which is responsive to said pressure pulses generated by the tachometer.

5. The in-hole motor driven drill of claim 4, in which said adjustment apparatus includes drilling lines and a winch for said drilling lines which holds the drilling lines under tension and means to impose a braking force on said winch drive responsive to the rpm of said motor and means to adjust said braking force responsive to said rpm to adjust the tension in the drilling lines to hold said rpm substantially constant.

6. The in-hole tachometer drill of claim 4, in which said adjustment apparatus includes drilling lines and a winch which holds said drilling lines under tension means to generate a braking force on said winch to hold said tension substantially constant during generation of said pulses.

7. An automatic in-hole turbine driven bit connected in a drill string suspended from drilling lines held under tension by draw works at the surface, said drill string including tachometer pulse generating means for telemetering pulses in the drilling fluid which is circulating from an input at the surface to the drill string and through the drill string, the tachometer pulse generating means, turbine and bit to the surface, said pulses being of a period responsive to the rpm of the turbine, comprising:

(a) an electromechanical pressure gauge at said input to sense said pressure pulses, said electromechanical pressure gauge reporting said pulses as an electrical signal, (b) a filter to substantially isolate the analogue signal portion of the electrical signal which is responsive to the pressure pulses telemetered by said tachometer pulse generating means, (c) means for generating an electrical signal responsive to the period between pulses of said analogue signal, (d) an electropneumatic transducer to convert said last named electrical signal into a fluid pressure, responsive to said signal, and (e) fluid pressure receiving means operatively connected to said draw works for maintaining said drilling lines under tension responsive to said last named fluid pressure.

8. The automatic in-hole turbine driven bit of claim 7, said draw works including a brake for the drum of the draw works, a pneumatic motor connected to the brake of the draw works, a pressure amplifier connected to said electropneumatic transducer, said pressure amplifier connected to said motor.

9. The in-hole motor driven drill of claim 7 further comprising means for storing said electrical signal responsive to the period between pulses of said analogue signal.

10. The in-hole motor driven drill of claim 7, in which said draw works maintains the drilling lines under substantially constant tension.

11. The in-hole motor driven drill of claim 7, in which said draw works maintain said drilling lines under substantially constant tension and which further comprises means for storing said electrical signal responsive to the period between pulses of said analogue signal.

12. The in-hole motor driven drill of claim 11, wherein said draw works include a brake for the drum of said draw works a pneumatic motor connected to the brake of the draw works, and means to connect said electropneumatic transducer to said brake.

13. The process of drilling a bore hole with an in-hole motor driven bit in a drill string supported by drilling lines held by draw works under tension during drilling which comprises the steps of: rotating said motor and bit by circulation of a drilling fluid through the motor and bit, generating a train of pulses in the drilling fluid circulating through the drill string in response to the rpm of the motor, telemetering said pulses to the surface, transforming said train of pulses into a signal which is indicative of the rpm of said motor, adjusting a brake on a drum of the draw works responsive to said signal to maintain the rpm of the motor substantially constant.

14. The process of claim 13, in which said step of adjusting includes generating a signal responsive to said train of pulses, generating a braking pressure on the drum of said draw works and maintaining said braking pressure substantially constant responsive to said signal.

* * * * *